US006327450B1

(12) United States Patent
Ito

(10) Patent No.: US 6,327,450 B1
(45) Date of Patent: Dec. 4, 2001

(54) IMAGE FORMING APPARATUS AND IMAGE FORMING METHOD USING COLOR TONER

(75) Inventor: Nobuyuki Ito, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/538,300

(22) Filed: Mar. 30, 2000

(30) Foreign Application Priority Data

Apr. 2, 1999 (JP) ..... 11-096999
Mar. 27, 2000 (JP) ..... 12-087204

(51) Int. Cl.[7] ..... G03G 15/01
(52) U.S. Cl. ..... 399/227; 399/54; 399/223
(58) Field of Search ..... 399/223, 226, 399/227, 39, 54; 347/115; 430/120, 45

(56) References Cited

FOREIGN PATENT DOCUMENTS 58-39468 3/1983 (JP) .
05-035038 * 2/1993 (JP) .
08-171252 * 7/1996 (JP) .
11-334151 * 12/1999 (JP) .

* cited by examiner

*Primary Examiner*—Sophia S. Chen
(74) *Attorney, Agent, or Firm*—Fitzpatrick, Cella, Harper & Scinto

(57) ABSTRACT

An image forming apparatus in which an image forming device has developing device for developing an electrostatic image formed on an image bearing member. The developing device has a first developing section for developing use of a first cyan toner, a second developing section for developing by use of a first magenta toner, a third developing section for developing by use of a yellow toner, a fourth developing section for developing by use of a second cyan toner that is lighter than the first cyan toner, and a fifth developing section for developing by use of a second magenta toner that is lighter than the first magenta toner. A sixth developing section is provided for developing by use of a black toner. A first rotator supports the first, second, third, fourth, fifth and sixth developing devices, and a second rotator supports the fourth and fifth developing devices.

9 Claims, 12 Drawing Sheets

FIG. 6

| MAXIMUM REFLECTION DENSITY OF TONER (light) | DISSOLUTION OF COARSENESS IN HALFTONE |
|---|---|
| 1.4 | FAILURE |
| 1.2 | FAILURE |
| 1.0 | FAILURE |
| 0.8 | GOOD |
| 0.6 | EXCELLENT |
| 0.4 | GOOD |

FIG. 7

| PARTICLE DIAMETER IN VOLUME AVERAGE OF TONER (light) (μm) | PARTICLE DIAMETER IN VOLUME AVERAGE OF TONER (light) (μm) | COARSENESS IN HALFTONE | MAXIMUM REFLECTION DENSITY | QUALITY OF CHARACTER IMAGE |
|---|---|---|---|---|
| 6 | 4 | EXCELLENT | GOOD | EXCELLENT |
| 6 | 6 | GOOD | GOOD | EXCELLENT |
| 6 | 8 | FAIR | GOOD | EXCELLENT |
| 10 | 6 | GOOD | EXCELLENT | GOOD |
| 10 | 4 | EXCELLENT | EXCELLENT | GOOD |
| 20 | 4 | EXCELLENT | EXCELLENT | FAILURE |

IMAGE FORMING APPARATUS AND IMAGE FORMING METHOD USING COLOR TONER

BACKGROUND OF THE INVENTION

1. Field of the Invention

The present invention relates to an image forming apparatus such as a copying machine, a printer and a facsimile machine which performs color image formation using an electrophotographic system and an image forming method.

2. Related Background Art

An image forming apparatus which forms a color image is put to practical use, for example, by sequentially superposing and transferring color toner images formed on a photosensitive drum which is an image bearing member, to a recording material such as paper held on a transfer drum (transfer film), as the image forming apparatus which forms the color image.

In such an image forming apparatus, an electrostatic latent image formed on a photosensitive drum based on an input image signal is developed with first color toner (for example, cyan) to form a toner image and this toner image is transferred to a recording material such as paper held on a transfer drum (transfer film). A color image can be obtained by also applying this transfer process to other three colors, that is, the toner of each color of magenta, yellow and black in the same manner, and by sequentially superposing and transferring 4-color toner images on a recording material.

Incidentally, if the color image forming apparatus described above is a color copying machine, for example, fine density unevenness is easily produced on a color image formed through copying in an original with low density and halftone such as a photograph original although it is hardly produced in a character original. In general, this density unevenness is called "coarseness".

In the density unevenness described above, cyan and magenta are visually easy to stand out clearly in particular among colors of cyan, magenta and yellow.

This unevenness cannot be found in ink-jet and printing. The biggest problems are an unstable element of image quality which cannot be forecast and a low frequency noise occurring on a macro basis when a large number of fine toner particles having a particle diameter of 5 to 10 $\mu$m forth a dot contour by being distributed at random. This is described below in detail.

FIG. 14 and FIG. 15 are output images of a practical electrophotographic photograph system and an ink-jet system respectively. FIG. 14 shows an appearance of fine toner (on copying paper) which forms a dither dot in the electrophotographic system by an enlarged diagram. FIG. 15 is an enlarged diagram of almost the same scale in which a similar dot was output on dedicated glossy paper by an ink-jet system (Epson PM700). Accordingly, for the electrophotographic system, it comes out that a dot does not have such a smooth contour shape as in the ink-jet system and a large number of fine toner particles having a fine particle diameter of 5 to 10 $\mu$m form a dot contour by being distributed at random. Further, the finish of a dot is also not the same. There are dots whose density is low or high and whose dot diameter is small or large. For a shape, it is not far from round (cylindrical) but is oval (distorted), and there is no shape which is equal one after another. The variation of these factors is almost random and contains considerably low frequency components. As a result, the variation becomes a cause of noise which can be seen with eyes.

The difference between toner density and paper density discriminates this noise. In particular, in comparison with an ink-jet system, this system remarkably receives the effect of an optical dot gain due to the distribution of an infinite amount of fine toner.

The main cause of the phenomenon described above is that an electrophotographic system uses a fine toner particle to form a dot. Further, there are various promoting causes. That is, they are un-sharpening of dot data in the latent image to developing to transfer process of the electrophotographic process, scattering of irregular ton®r resulting from values of physical properties (electrical resistance and surface roughness) of copying paper and a phenomenon resulting from the adhesion in the developing process described below.

For a one-component developer, the adhesion force between toner and a developing sleeve, and for a two-component developer, the adhesion force between the toner and a carrier (mainly reflection force of the toner on a developer bearing member) are strong, whereas the charging distribution of the toner is uneven. Therefore, if these toner are peeled off at a developing bias voltage and made to fly onto a photosensitive drum, such unstable image formation as the toner at one place is easy to fly and the toner at another place is hard to fly occurs, and unevenness will occur in the formation of a dot.

On the other hand, because in the gradation ink process of such an ink-jet system as can be seen in Japanese Patent Application Laid-Open No. 58-39468, the ink-jet system itself is simple and the performance of dedicated paper which supports the current high quality image is excellent, the problem of such an electrophotographic system as described above does not occur.

Therefore, in the improvement of graininess which is the effect of gradation ink used in an ink-jet system, it is proved that light toner has a more greater effect of an electrophotographic system on the remarkable low frequency noise resulting from the "fluctuation of toner density at which a dot is formed", "fluctuation of a dot area" and "fluctuation of a dot shape" described above than the ink-jet system.

Moreover, it is proved that the introduction of light toner to an electrophotographic system brings about an innovative progress in that an optical dot gain which did not cause any problem in an ink-jet system has caused a great hindrance when high quality is aimed at in the electrophotographic system which uses an indefinite amount of fine toner, too.

As shown in FIG. 12, in a practical copy line "PCL" against ideal copy, the density of a copy (reflection density of a copy) shows a characteristic that the density is lower than the density of an original (reflection density of an original) in a low density area and the density of the copy suddenly increases from the vicinity of intermediate density of the density of the original and then the maximum density is reached quickly. This results from the adhesion force in the developing process described previously.

The maximum density (maximum reflection density) is additionally described below. FIG. 12 shows a phenomenon which can he described in accordance with FIG. 13. That is, it is assumed that the lower vertical axis shows the density data of an original or digital image data read by a scanner or the like and the horizontal axis shows the voltage difference (developing contrast) between the potential of a latent image formed by charging to laser exposure after the information has been converted to data for optical writing and the voltage applied to a developing bias voltage. The correction is made to the original density date to developing contrast according to a case, but if a straight line without correction is used, the curve of FIG. 12 is controlled by a developing system, that is, an amount of toner coat on a developing sleeve, an amount of toner charging, the capacitance of a photosensitive body, the peripheral ratio between a process speed and the developing sleeve, a developing bias voltage and the like.

As shown in FIG. 13, if the direct current component of the developing bias voltage is changed arid the developing contrast increases, a curve is weakened because electrical capacitance or an amount of toner which can be supplied is saturated. That is, in the image forming apparatus, the maximum density on transfer paper the toner can produce is reached.

SUMMARY OF THE INVENTION

Thus, an object of the present invention is to provide an image forming apparatus and an image forming method which suppresses the occurrence of density unevenness and can perform high quality image formation even for a light (thin) halftone image.

Another purpose and characteristic of the present invention will be further made clear by reading the following detailed description referring to attached drawings.

BRIEF DESCRIPTION OF THE DRAWINGS

FIG. 6 is a diagram showing an evaluation result, in an embodiment 1 of the present invention;

FIG. 7 is a diagram showing an evaluation result in an embodiment 2 of the present invention;

DETAILED DESCRIPTION OF THE PREFERRED EMBODIMENTS

The embodiments of the present invention are described below in accordance with the drawings.

<Embodiment 1>

Figure 1:
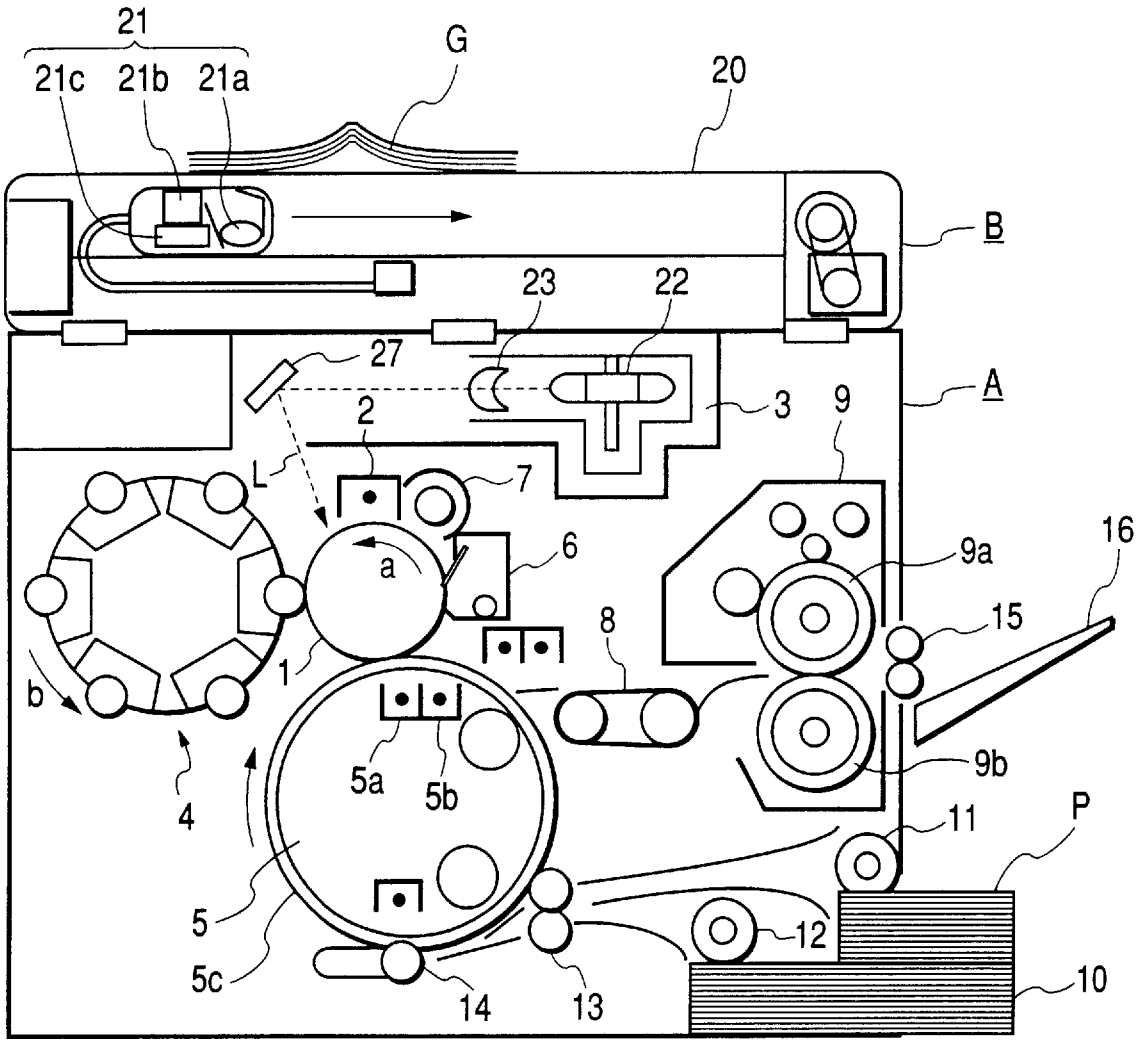
FIG. 1 is a schematic constructional view showing an image forming apparatus according to an embodiment 1 of the present invention.

FIG. 1 is a schematic constructional view showing an image forming apparatus (in this embodiment, a full color copying machine provided with a transfer drum) according to an embodiment 1 of the present invention.

In FIG. 1, A denotes a printer portion and B denotes an image reading portion (image scanner) mounted on thus printer portion A.

In the image reading portion B, 20 is a fixed original stand glass. An original G is loaded with the surface to be copied downside up on the top of this original stand glass 20 and is set on it by being covered with an original plate not shown. 21 denotes an image reading unit in which a lamp 21*a* for illuminating an original, a short focal point lens array 21*b* and a CCD sensor 21*c* are arranged.

This image reading unit 21 is moved forward and driven from the home position on the left side of this original stand glass 20 to the right side along the glass lower surface at the lower side of the original stared glass 20 when a copy button not shown in the diagram is depressed. When a predetermined reciprocal end point is reached, the unit is moved backward and driven and returns to the initial home position.

In the moving-forward drive process of the image reading unit 21, the downward image surface of the set original G loaded on the original stand glass 20 is sequentially illuminated and scanned from the left side to the right side by the lamp 21*a* for illuminating the original and the reflected light on the original surface of the illuminated and scanned light is focused on the CCD sensor 21*c* by the short focal point lens array 21*b*.

The CCD sensor 21*c* comprises a light receiving portion (not shown), a transfer portion and an output portion. An optical signal is converted to a charge signal in the light receiving portion and is sequentially transferred to the output portion synchronizing with a clock pulse in the transfer portion. The charge signal is converted to a voltage signal, amplified and output as a low impedance signal in the output portion. An analog signal obtained in this manner is converted to a digital signal by known image processing and output to the printer portion A. That is, the image information of the original G is photoelectrically read by the image reading portion B as a time series electric digital pixel signal (image signal).

On the other hand, in the printer portion A, a primary charger 2, a developing device 4, a transfer drum 5, a cleaning device 6, a pre-exposure lamp 7 and the like are provided around a photosensitive drum 1 as an image bearing member. Further, a fixing device 9 is installed on the downstream side in the transfer material conveying direction of the transfer drum 5 and an exposure device (laser scanning device) according to a laser beam scanning exposure system is installed on the top of the printer portion A.

The photosensitive drum 1 is an organic photosensitive body of negative charging in this embodiment and has a photoelectric layer on a conductive drum substrate (not shown) such as aluminum. The photosensitive drum is rotated and driven in the arrow direction (counterclockwise direction) at a predetermined speed and receives even charging processing of negative polarity by the primary charger 2 in this embodiment.

The exposure device 3 effects a laser scan exposure L on the surface of the photosensitive drum 1 on the basis of an image signal input from the image reading unit 21 and forms an electrostatic latent image.

Figure 2:
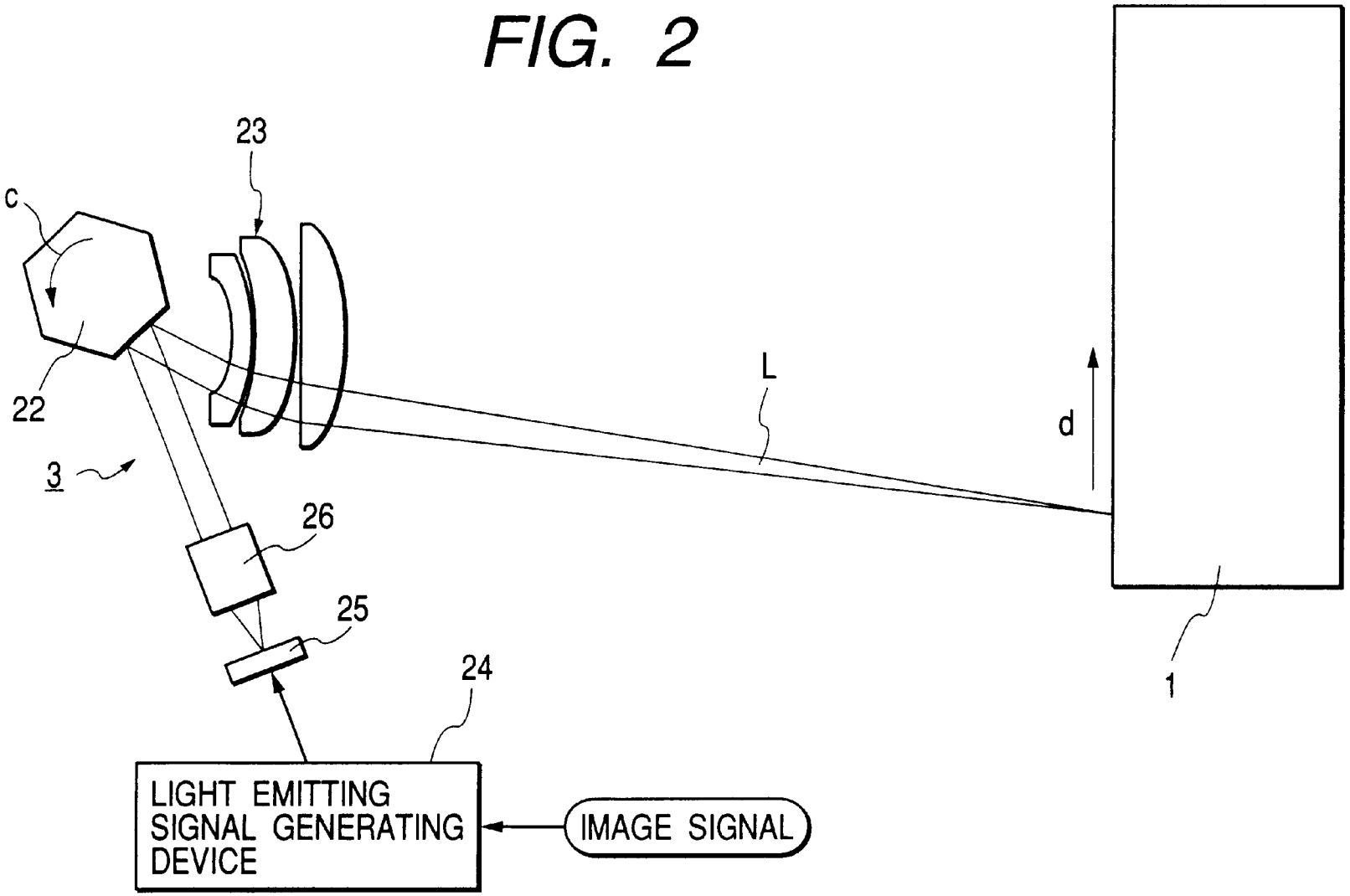
FIG. 2 is a schematic constructional view showing an exposure device (laser beam scanner) of an image farming apparatus according to an embodiment 1 of the present invention.

FIG. 2 is a schematic constructional view showing the exposure device 3. If this exposure device 3 effects the laser scan exposure L on the surface of the photosensitive drum 1, first a solid-state laser element 25 blinks on/off by a light emission signal generator 24 based on an image signal input from the image reading unit 21. Then, the laser beam which is an optical signal irradiated from the solid-state laser element 25 is converted to an almost parallel luminous flux by a collimator lens system 26 and moreover a laser spot is focused on the surface of the photosensitive drum 1 by a group of fθ lenses 23 and a reflecting mirror 27 (refer to FIG. 1) by scanning the photosensitive drum 1 in the direction of an arrow d (longitudinal direction) by a rotating polygon mirror 22 which rotates at high speed in the direction of an arrow c. Exposure distribution for scanning is formed on the surface of the photosensitive drum 1 by such laser scanning and moreover, if the surface of the photosensitive drum 1 is scrolled by a predetermined amount perpendicularly to the surface for each scanning, the exposure distribution which conforms to an image signal is obtained on the surface of the photosensitive drum 1.

That is, an electrostatic latent image having each color which corresponds to a scanning exposure pattern is sequentially formed on the surface of the photosensitive drum 1 by scanning the light of the solid-state laser device 25 which is on/off emitted corresponding to an image signal on the uniform charging surface of the photosensitive drum 1, by the rotating polygon mirror 22 which rotates at high speed. In this embodiment, the image consists of six colors: cyan, cyan lt, magenta, magenta lt, yellow and black.

The cyan lt is light-colored cyan whose maximum reflection density is lower, i.e., lighter than cyan and the magenta lt is light-colored magenta whose reflection density is lower, i.e., lighter than magenta.

Figure 3:
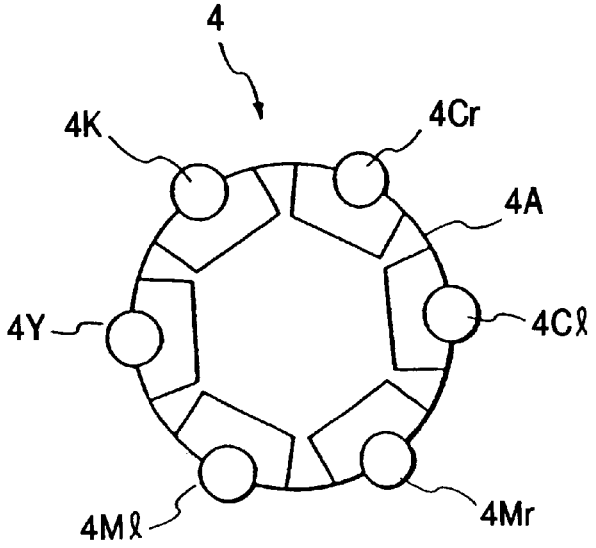
FIG. 3 is a schematic constructional view showing a developing device of an image forming apparatus according to an embodiment S of the present invention.

The developing device 4, as shown in FIG. 3, supports a cyan developing device 4Cr containing cyan toner, a cyan developing device 4Cl containing the cyan lt toner, a magenta developing device 4Mr containing magenta toner, a magenta developing device 4Ml containing the magenta lt toner, a yellow developing device 4Y containing yellow toner and a black developing device 4K containing black toner, on a rotator 4A which can freely rotate, and an electrostatic latent image formed on the photosensitive drum 1 is developed and visualized (revealed) according to a reversal developing system. In this embodiment, the electrostatic latent image is developed in the sequence of cyan, cyan lt, magenta, magenta lt, yellow and black by six developing devices of the cyan developing device 4Cr, the cyan lt developing device 4Cl, the magenta developing device 4Mr, the magenta lt developing device 4Ml, the yellow developing device 4Y and the black developing device 4K.

Figure 4:
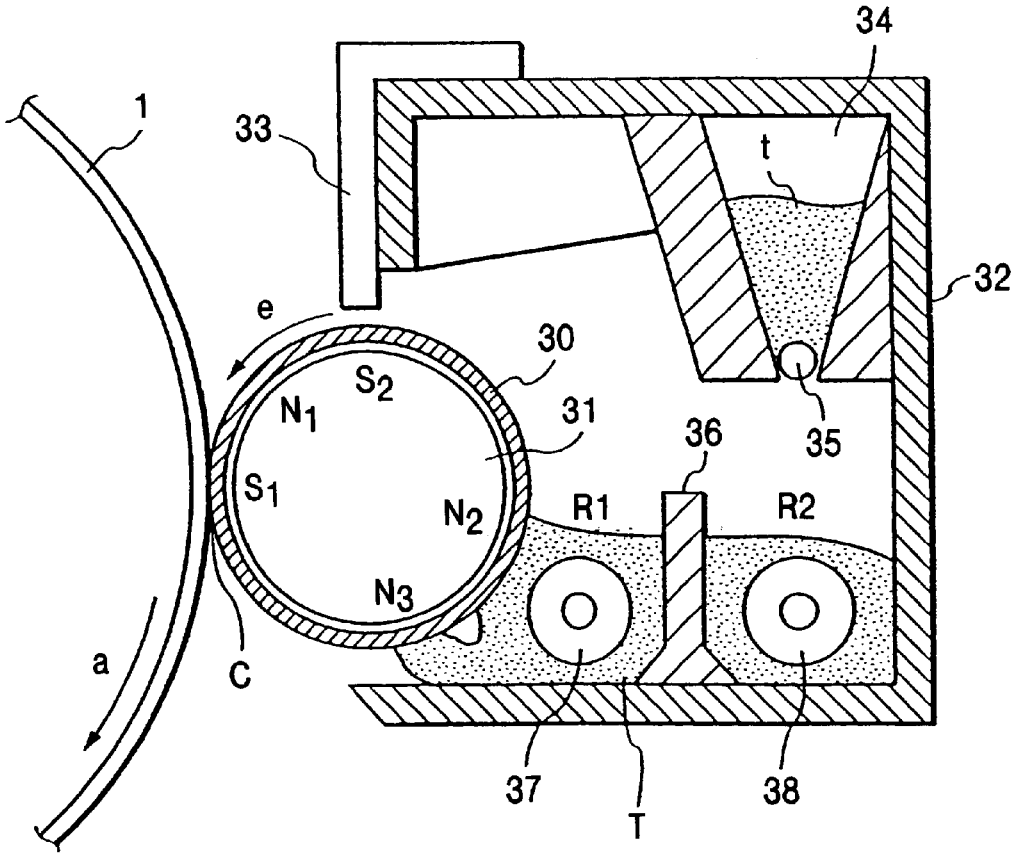
FIG. 4 is a schematic cross section view showing the configuration of a two-component developing device.

In this embodiment, a two-component developing device shown in FIG. 4 is used as the cyan developing device 4Cr, the cyan lt developing device 4Cl, the magenta developing device 4Mr, the magenta lt developing device 4Ml, the yellow developing device 4Y or the black developing device 4K.

Each of these two-component developing devices is provided with a developing sleeve 30 which rotates and a is driven in the direction of an arrow a and a magnet roller 31 is fixed and arranged in the developing sleeve 30. A regulating blade 33 for forming a developer T on the surface of the developing sleeve 30 in a thin layer is installed in a developing container 32.

Further, the inside of the developer container 32 is partitioned into a developing chamber (first chamber) R1 and an agitating chamber (second chamber) R2 by a partition wall 36 and a toner hopper 34 is arranged on the top of the agitating chamber R2. Carrying screws 37 and 38 are installed in the developing chamber R1 and the agitating chamber R2 respectively. Besides, a replenishing port 35 is installed in the toner hopper 34 and, at toner replenishment, toner t drops and is replenished in the agitating chamber R2 via the replenishing port 35.

On the other hand, the developer T in which the toner particle and magnetic carrier particle are mixed is contained in the developing chamber R1 and the agitating chamber R2.

As the toner t, a known toner in which a coloring agent or a charging control agent are added to binder resin can be used, and the particle diameter in volume average of the toner t is 6 $\mu$m.

The particle diameter in volume average of the toner t can be measured according to the following measuring method, for example.

For example, using a Coulter Counter Type TA-II (manufactured by Coulter Inc.) as a measuring device, an interface (manufactured by Nikkaki K.K.) which outputs distribution of a number average and distribution of a volume average and a CX-i Personal Computer (manufactured by Canon Inc.) are connected, and for an electrolytic solution, a 1% Nacl aqueous solution is adjusted using first-class sodium chloride.

As a measuring method, a surface-active agent (desirably alkylaryl sulfonates) is added 0.1 to 5 ml (0.1×10"6 to $5\times10^{-6}$ $m^3$) in the electrolytic aqueous solution of 100 to 150 ml ($100\times10^{-6}$ to $150\times10^{-6}$ $m^3$) as an dispersing agent and a measuring sample of 0.5 to 50 mg is added. Dispersion treatment is performed to an electrolytic solution in which this sample is suspended by a ultrasonic disperser for about one to three minutes, and the particle size distribution of a particle of 2 to 40 $\mu$m is measured by a measuring device (coulter Counter Type TA-II) using a 100 $\mu$m aperture as the aperture to determine volume distribution. The particle diameter in volume average of a sample is obtained according to these types of volume distributions.

On the other hand, a magnetic carrier in which exceedingly thin resin coating applies to the surface of a magnetic particle is desirably used, and it is desirable that the average particle diameter be 5 to 70 $\mu$m. The average particle diameter of the carrier is represented in the maximum string length in the horizontal direction. For a measuring method, 300 or more carriers are selected at random by a microscopic method and the carrier particle diameter of this embodiment is obtained by actually measuring the diameter and calculating an arithmetical mean.

Further, the developer T of the developing chamber R1 is carried toward the longitudinal direction of the developing sleeve 30 by the rotation and drive of the carrying screw 37. The developer T of the agitating chamber R2 is carried to the longitudinal direction of the developing sleeve 30 by the rotation and drive of the carrying screw 38. The developer carrying direction by the carrying screw 38 is reverse to that by the carrying screw 37.

An opening (not shown) is installed at this side which is in the perpendicular direction with space and the inner side (that side) on the partition wall 36 respectively. The developer T carried by the carrying screw 37 is transferred from one of these openings to the carrying screw 38 and the developer T carried by the carrying screw 38 is transferred from the other of the openings to the carrying screw 36. Toner is charged to a polarity for developing a latent image due to friction with a magnetic particle.

The developing sleeve 30, consisting of a non-magnetic material such as aluminum or non-magnetic stainless copper, is installed in the opening which is provided at a location adjacent to the photosensitive drum 1 of the developer container 32. When the photosensitive drum rotates in the direction of the arrow e (counterclockwise direction), the developing sleeve 30 bears and carries the developer T in which toner and a carrier are mixed to a developing portion C. A magnetic brush for the developer T borne in the developing sleeve 30 touches the photosensitive drum 1 which rotates in the direction of an arrow a (clockwise direction) in the developing portion C and an electrostatic latent image is developed in this developing portion C.

An oscillating bias voltage in which a direct current voltage is superposed on an alternating voltage by a power supply (not shown) applies to the developing sleeve 30. The dark portion potential (non-exposure portion potential) and light portion potential (exposure portion potential) of a latent image is located between the maximal and minimal values of the oscillating bias potential. Accordingly, an alternating electric field whose orientation changes alternately is formed on the developing portion C. In this alternating electric field, toner and a carrier oscillates hard. The toner shakes off the electrostatic restraints of the developing sleeve 30 and the carrier and adheres to the light portion on the surface of the photosensitive drum 1 corresponding to the latent image.

The difference (voltage between peaks) between the maximal and minimal values of an oscillating bias voltage is desirably 1 to 5 KV, and the frequency is desirably 1 to 10 KHz. Further, as the waveforms of the oscillating bias voltage, a rectangular wave, a sine wave and a triangular wave can be used.

Then, it is desirable for preventing adhesion of fog toner to the dark portion potential area that the AC voltage component described above has a value between the dark portion potential and the light portion potential of an electrostatic latent image, and has a nearer value to the dark portion potential than the minimum light portion potential in the absolute value. Further, it is desirable that the minimum gap (the position of this minimum gap can be found in the developing portion C, between the developing sleeve 30 and the photosensitive drum 1 be 0.2 to 1 mm.

Further, it is desirable that an amount of the developer T regulated by the regulating blade 33 and carried to the developing portion C by the regulating blade 33 be 1.2 to three times the minimum gap value between the developing sleeve 30 and the photosensitive drum 1.

The developing magnetic pole S1 of the magnet roller 31 is arranged at the position opposed to the developing portion C and the magnetic brush for the developer T is formed according to the developing field which the developing magnetic pole S1 forms in the developing portion C. This magnetic brush touches the photosensitive drum 1 and develops a dot distribution electrostatic latent image. At that time, the toner adhering, to the ear (brush) of a magnetic carrier and the toner adhering to the surface of a sleeve instead of this ear are transferred to the exposure portion of an electrostatic latent image and this image is developed.

It is desirable that the peak value of the strength (magnetic flux density in the perpendicular direction to the surface of the developing sleeve 30) on the surface of the developing sleeve 30 of a developing magnetic field by the developing magnetic pole S1 be 500 to 2,000 gausses ($5\times10^{-2}$ to $2\times10^{-1}$ T). Further, the magnet roller 31 comprises N1, N2, N3 and S2 poles in addition to the developing magnetic pole S1.

The developing process in which an electrostatic latent image on the surface of the photosensitive drum 1 is revealed according to a two-component magnetic brush method using the developing device 4 and a circulating system of the developer T is described here.

The developer T drawn up in the N2 pole by the rotation of the developing sleeve 30 is carried from the S2 pole to the N1 Pole. A layer thickness is halfway regulated by the regulating blade 33 and a developer thin layer is formed. Then, the developer T eared up in the magnetic field of the developing magnetic pole S1 develops an electrostatic latent image on the photosensitive drum 1. Subsequently, the developer T on the developing sleeve 30 drops in the developing chamber R1 according to the repulsive magnetic field between the N3 and N2 poles. The developer T dropped in the developing chamber R1 is agitated and carried by the carrying screw 37.

The transfer drum 5 stretches a transfer sheet 5*c* made of a polyethylene terephtalate resin film, for example, on the surface and is installed so as to freely touch against the photosensitive drum 1. The transfer drum 5 rotates and is driven in the direction of an arrow (clockwise direction). A transfer charger 5*a,* a separate charger 5*b* and the like are installed in the transfer drum 5.

Next, the image forming operation of the image forming device described above is described.

The photosensitive drum 1 rotates and is driven in the direction of an arrow a counterclockwise direction) at a predetermined peripheral speed (process speed) centered around a center spindle, in the process of rotation, receives uniform charging processing of negative polarity by the primacy charger 2 in this embodiment.

Then, an electrostatic latent image of each color which corresponds to the image information of an original G read photoelectrically by the image reading portion B is sequentially formed on the photosensitive drum 1 by scanning exposure L using the laser beam modulated corresponding to an image signal which is output from the exposure device (laser scanning device) 3 on the uniform charging surface of the photosensitive drum 1 and output from the image reading portion B to the printer portion A side. The electrostatic latent image formed on the photosensitive drum 1 is first subjected to reverse developing by the cyan developing device 4Cr according to the two-component magnetic brush method and is visualized as a toner image (cyan toner image of the first color) by the developing device 4.

On the other hand, a transfer material P such as paper housed in a sheet feeding cassette 10 is fed to a sheet feeding roller 11 or 12 one by one synchronizing with the formation of the toner image onto the photosensitive drum 1 and is fed to the transfer drum 5 at prescribed timing by a registration roller 13. Then, the transfer material P is electrostatically adsorbed on the transfer drum 5 by an adsorbing roller 14. The transfer material P electrostatically adsorbed on the transfer drum 5 moves to the position opposed to the photosensitive drum 1 by the rotation in the arrow direction (clockwise direction) of the transfer drum 5. An electric charge of inverse polarity to the toner is applied to the rear of the transfer material P by the transfer charger 5*a* and a toner image (cyan toner image) on the photosensitive drum 1 is transferred on the surface side.

After this transfer, the transfer residual toner left on the photosensitive drum 1 is removed by the cleaning device 6 and is used for formation of a toner image of the next color.

Subsequently, an electrostatic latent image on the photosensitive drum 1 is developed by the cyan lt developing device 4Cl, the magenta developing device 4Mr, the magenta lt developing device 4Ml, the yellow developing device 4Y and the black developing device 4K in which each color toner of cyan lt, magenta, magenta lt, yellow or black is contained in the same manner respectively. A cyan lt toner image, a magenta toner image, a magenta lt toner image, a yellow toner image and a black toner image sequentially formed on the photosensitive drum 1 are sequentially superposed and transferred to the transfer material P on the transfer drum 5 (transfer sheet) by the transfer charger 5*a* and a full color image is formed.

Besides, when the image described above is formed, the same electrostatic latent image is developed by each toner of cyan and cyan lt and the same electrostatic latent image is developed by each toner of magenta and magenta lt.

Then, the transfer material P is separated from the transfer drum 5 (transfer sheet) by the separating charger 5*b* and the separated transfer material P is conveyed to the fixing device 9 through the conveying belt 8. After the transfer material P conveyed to the fixing device 9 has been heated and pressurized between a fixing roller 9*a* and a pressing roller 9*b* and a full color image has been fixed on the surface, it is discharged on a tray 16 by a discharging roller 15.

Further, transfer residual toner is removed from the surface of the photosensitive drum 1 by the cleaning device 6 and the surface of the photosensitive drum 1 is discharged by the pre-exposure lamp 7 to make preparations for the next image formation.

Figure 5:
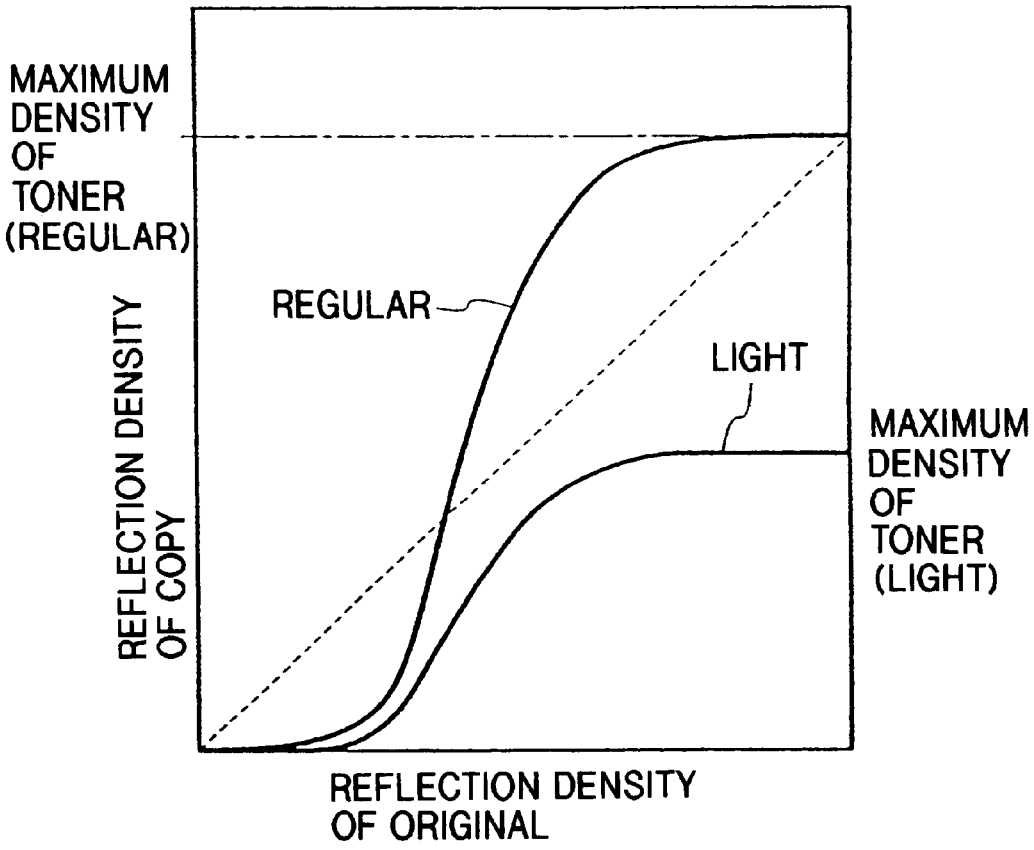
FIG. 5 is a diagram showing the relationship between the reflection density of an original and the reflection density of a copy according to an embodiment 1 of the present invention.

As described above, this embodiment has the configuration in which an image is developed by the six-color toner of cyan, cyan lt, magenta, magenta lt, yellow and black. In particular, if the density of a copy is compared with the density of an original regarding cyan toner, as shown in FIG. 5, the cyan developing device 4Cr uses such cyan toner as the maximum reflection density may reach about 1.6 and the cyan developing device 4Cl uses such cyan lt toner as the maximum reflection density may reach 0.4, 0.6, 0.8, 1.0, 1.2 and 1.4. Then, when the effect is evaluated regarding the density unevenness (coarseness) of a halftone image which is the issue described above, such a result as shown in FIG. 6 is obtained. Besides, in FIG. 5 and FIG. 6, toner "Reg." is cyan toner and toner lt is cyan lt toner. Moreover, the average particle diameter of toner is 6 $\mu$m for both the cyan toner and cyan lt toner. The maximum reflection density is measured by a Macbeth reflecting densitometer.

The judgment of a level of dissolution of coarseness is a subjective evaluation. Coarseness is observed separating a sample and eyes about 30 centimeters. If no change can be seen, "failure" is assumed. If a change is made toward a good feeling of graininess, "good" is assumed. "Excellent" is assumed for a group which was able to be judged as especially good in types of "good". Fair" is assumed for a group which was able to be judged as especially bad in types of "good".

As shown clearly from this evaluation result, if the maximum reflection density of cyan lt toner is equal to or less than 0.8 which is half the maximum reflection density of cyan toner, it is proved that the density unevenness (coarseness) of a halftone image is removed. In this embodiment, the effect is finest when the maximum reflection density of the cyan lt toner is 0.6.

Besides, the relationship between magenta toner and magenta lt toner is also the same. If the maximum reflection density of magenta lt toner is equal to or less than 0.8 which is half the maximum reflection density of magenta toner, the density unevenness (coarseness) of a halftone image is removed. Moreover, the average particle diameter is 6 $\mu$m for both the magenta toner and magenta lt toner.

Thus, in this embodiment, the toner image of each color is developed on the photosensitive drum 1 with the toner of each color of cyan, magenta, yellow arid black, and moreover, density unevenness (coarseness) is removed even in a halftone image and a high-quality image can be obtained by developing the toner image of each color of cyan lt toner and magenta lt toner with the cyan lt toner of a cyan color provided with the maximum reflection density that is below half the maximum reflection density of cyan toner and the magenta lt toner of a magenta color provided with the maximum reflection density that is equal to or less than half the maximum reflection density of magenta toner.

<Embodiment 2>

According to the investigation made by this inventor, when a dot toner image in a halftone area immediate after developing has been performed on the photosensitive drum, it is made clear that the toner having a 1 to 2 $\mu$m smaller toner particle diameter than the average toner particle diameter (6 $\mu$m) is initially collected and its dot toner image is formed.

That is, the particle diameter of toner in a low density area is smaller than the average particle diameter of the toner which forms the entirety. This is because small toner is large in an amount of electric charge (triboelectricity) per unit weight and good in operation performance, and can fully follow up an electrostatic latent image via fine dot forms and an electric field occurring at a developing bias voltage at developing.

Further, large toner (toner containing a larger number of pigments) whose amount of electric charge per unit weight is low (the lower the triboelectricity of developing toner is, the more toner is developed for the same electrostatic latent image) may adhere to the portion in which thick density is required.

Therefore, in this embodiment, the developing of the portion (second portion) which is to form the low density portion of an electrostatic latent image is performed with cyan lt toner and magenta lt toner and the developing of the portion (first portion) which is to form the high density portion of the electrostatic latent image is performed with cyan toner and magenta toner. In the above, the portion which is to form the high density portion and the portion which is to form the low density portion differ in an image signal of laser and in a latent image. For example, when an image of an original is read, it is acceptable that the portion whose original density is equal to or less than a predetermined value be specified for the low density portion and the portion whose original density is more than the predetermined value be specified for the high density portion.

Further, in this embodiment, when the result is evaluated regarding the density unevenness (coarseness) of a halftone image, the maximum reflection density and the quality of a character image by varying the particle diameter in the volume average of cyan toner or magenta toner, and cyan lt toner or magenta lt toner, such a result as shown in FIG. 7 is obtained. Besides, in FIG. 7, toner Reg is cyan toner or magenta toner, and toners Light is cyan lt toner or magenta lt toner. Moreover, the maximum reflection density of the cyan toner and magenta toner is 1.6 and the maximum reflection density of the cyan lt toner and magenta lt toner is 0.8.

As shown clearly from this evaluation result, if the particle diameter in volume average of cyan lt toner is 2 $\mu$m or more smaller than the particle size in volume average of cyan toner, the particle size in the volume average of magenta lt toner is 2 $\mu$m or more smaller than the particle size in volume average of magenta toner and the particle sizes of volume average of the cyan toner or magenta toner are properly small (in this embodiment, not more than 6 μm and desirably 4 μm), the density unevenness (coarseness) of a halftone image can be removed.

Further, when the particle sizes in the volume average of cyan toner and magenta toner are properly large (in this embodiment, 10 μm or more, and desirably 20 μm), the maximum reflection density can be increased and a high-quality image can be obtained in a character image.

<Embodiment 3>

Figure 8:
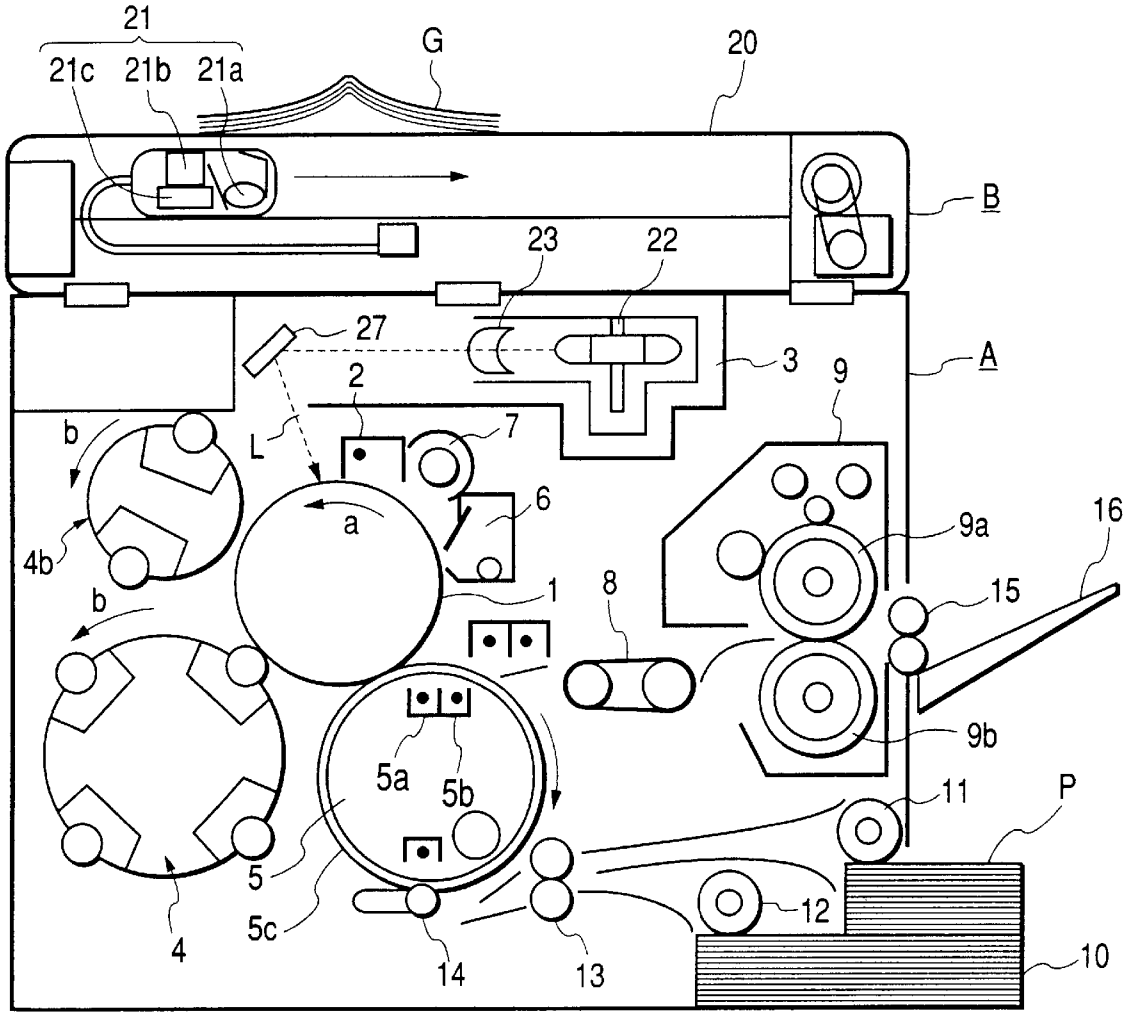
FIG. 8 is a schematic constructional view showing an image forming apparatus according to an embodiment 3 of the present invention.

FIG. 8 is a schematic constructional view showing an image forming apparatus according to this embodiment.

This embodiment has the configuration in which a two-color rotating type developing device 4*l* for a high-quality image mode is provided in a normal four-color rotating type developing device 4*r* around the photosensitive drum 1. Another configuration is the same as the image forming apparatus of embodiment 1 shown in FIG. 1 and an overlapping description is omitted.

Figure 9A:
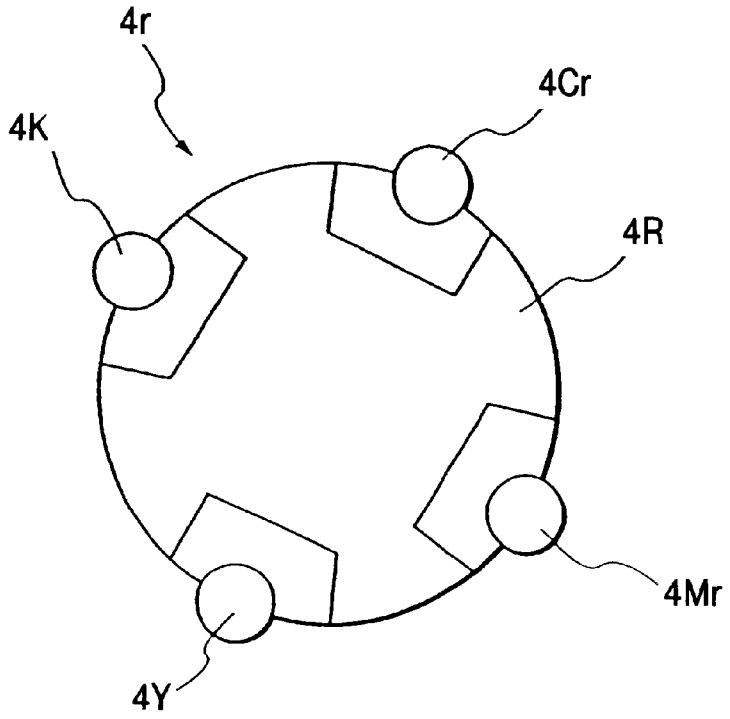
FIGS. 9A and 9B are schematic constructional views showing a developing device of an image forming device in an embodiment 3 of the present invention.
Figure 9B:
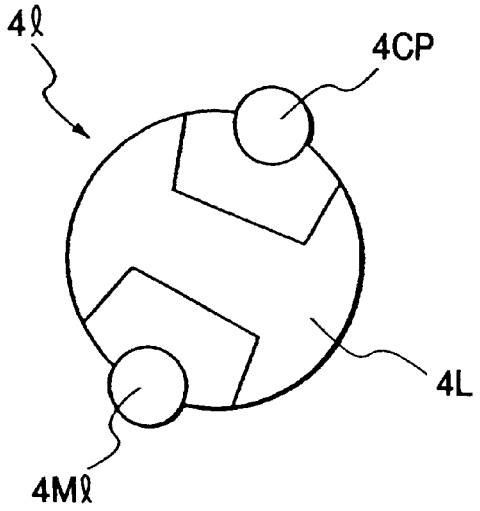

This image forming apparatus, as shown in FIG. 9A and FIG. 9B, comprises the developing device 4*r* having the cyan developing device 4Cr containing cyan toner, the magenta developing device 4Mr containing magenta toner, the yellow developing device 4Y containing yellow toner and the black developing device 4K containing black toner in a first rotator 4R and the developing device 4*l* having the cyan developing device 4Cl) containing the cyan lt toner and the magenta developing device 4Ml containing the magenta lt toner in a second rotator 4L. The developing operation is the same as that of the developing device 4 of embodiment 1. In the normal mode, a four-color developing device supported on the rotator 4R is used, and in the high-quality image mode, a two-color developing device supported on the rotator 4L is used in addition to the four-color developing device. In the high-quality image mode, multiple developing is performed with the cyan toner and cyan lt toner for one latent image for a cyan color and multiple developing is performed with the magenta toner and magenta lt toner to one latent image for a magenta color.

Thus, in this embodiment, too, the density unevenness (coarseness) of a halftone image can be removed in the same manner of embodiment 1, and moreover the image formation of the normal mode and the image formation of the high-quality image mode can optionally be switched by enabling the configuration in which the two-color rotating type developing device 4*l* for the high-quality image mode to the normal four-color rotating type developing device 4*r*, and this is also advantageous to maintenance.

Figure 10:
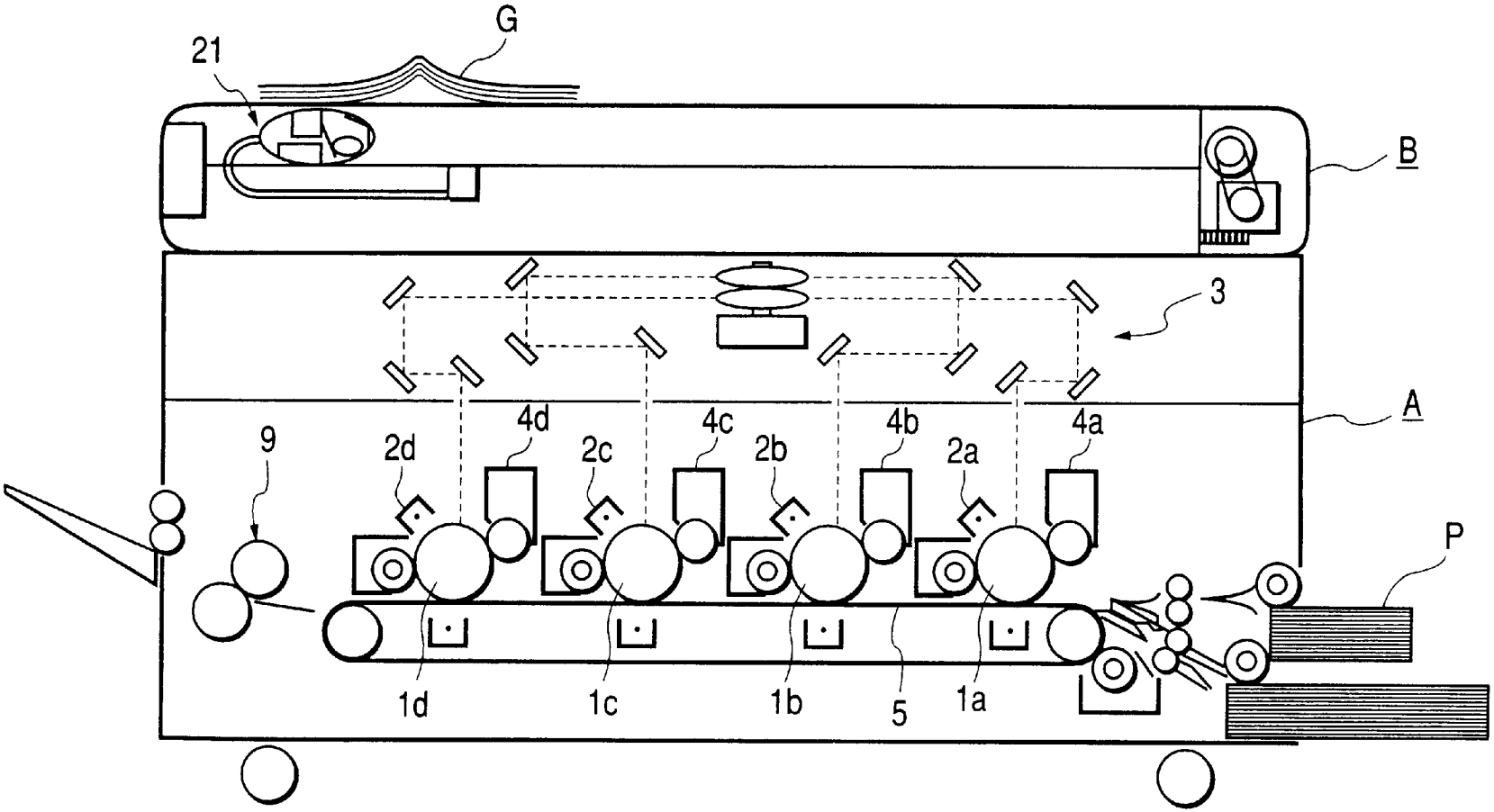
FIG. 10 is a schematic constructional view showing an image forming apparatus according to a tandem developing system.
Figure 11:
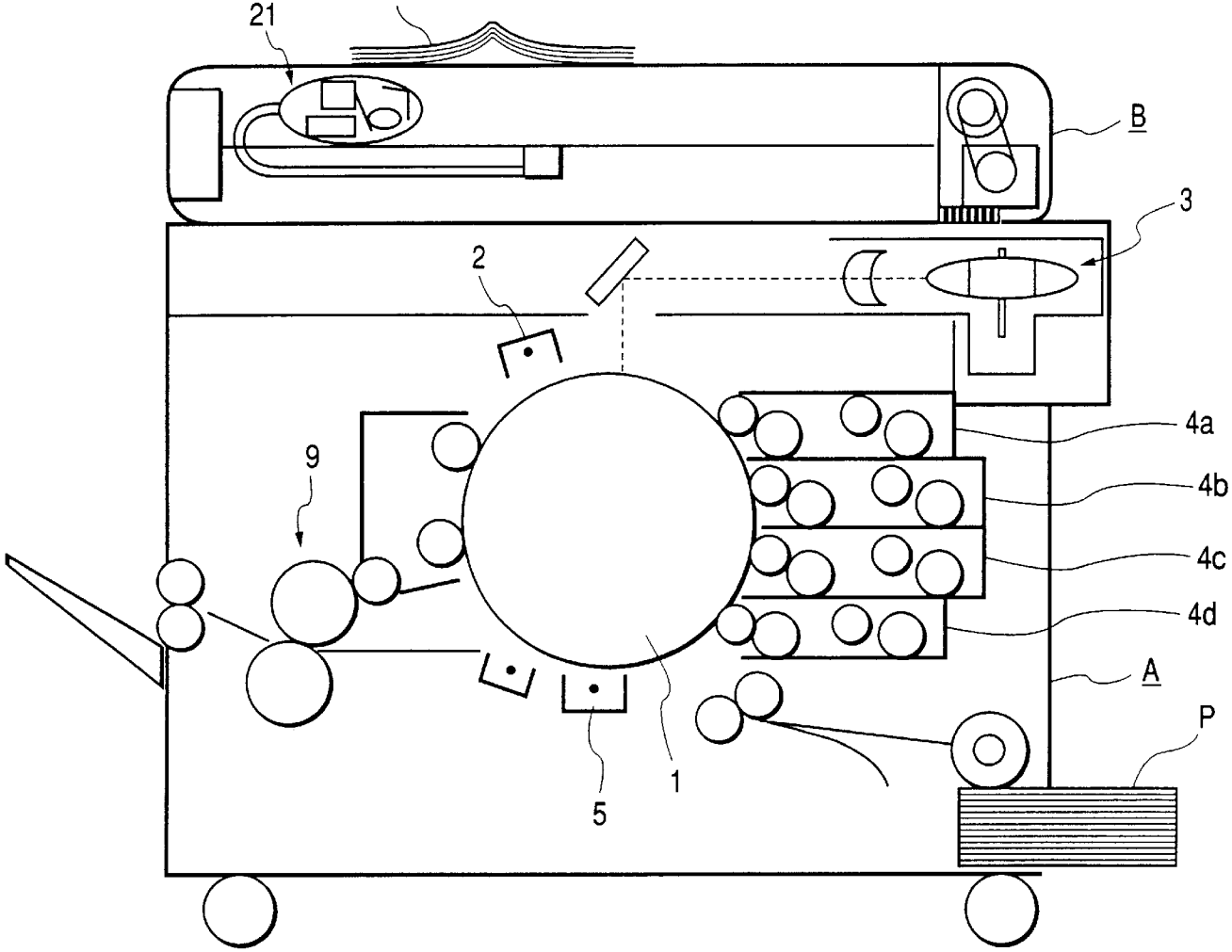
FIG. 11 is a schematic constructional view showing an image forming apparatus according to a multiple developing system.
Figure 12:
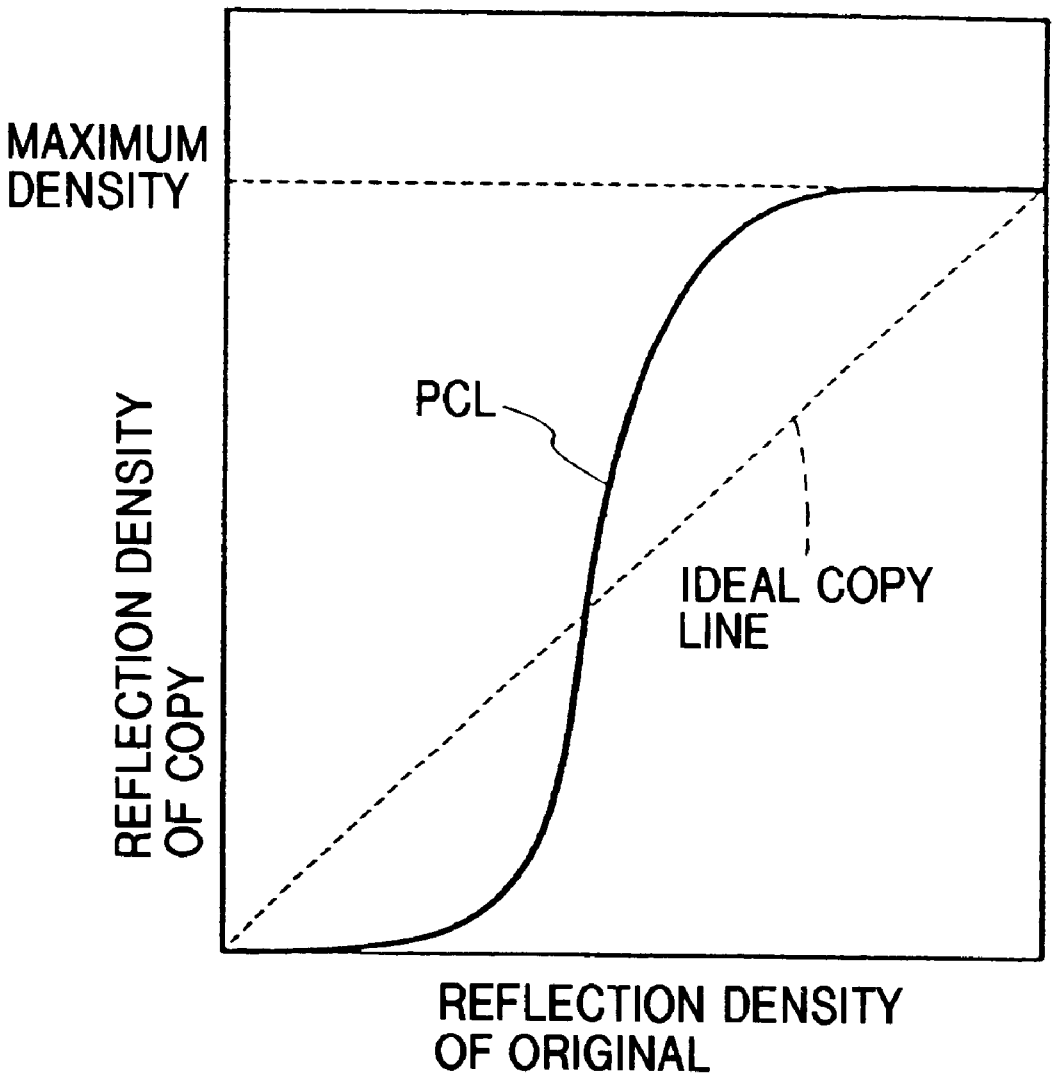
FIG. 12 is a diagram showing the relationship between the reflection density of an original and the reflection density of a copy in a conventional example.
Figure 13:
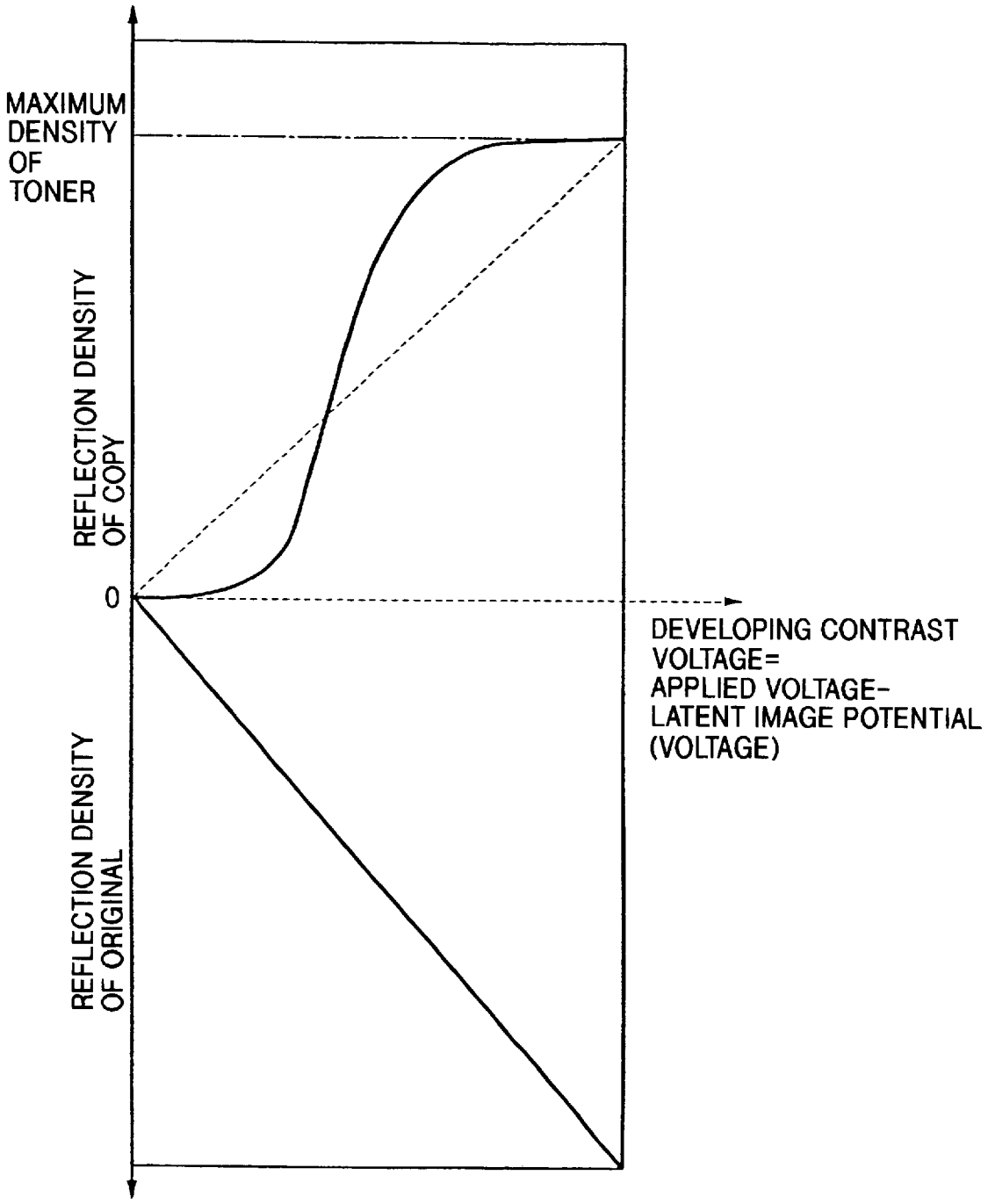
FIG. 13 is a diagram showing the relationship between the reflection density of an original and the reflection density of a copy in relation to a developing contrast voltage.
Figure 14:
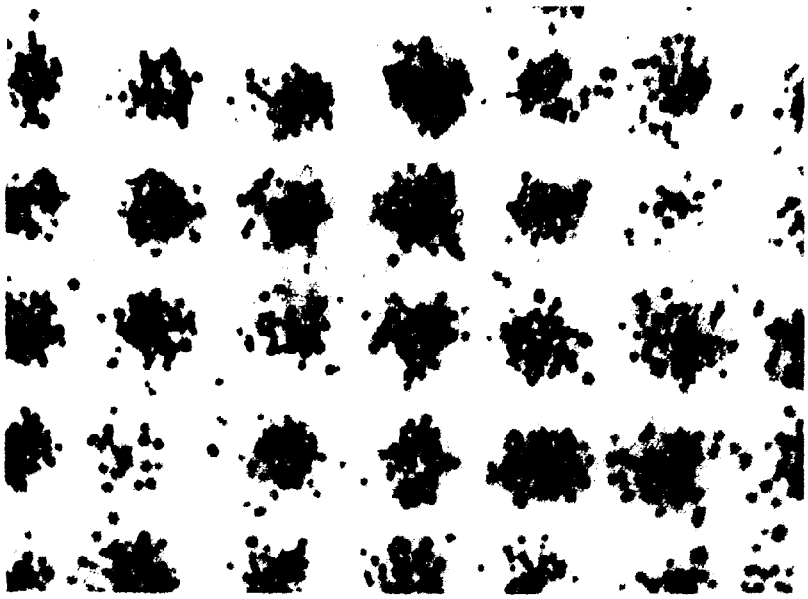
FIG. 14 is an enlarged diagram in which a dither dot is output on paper according to an electrophotographic system.
Figure 15:
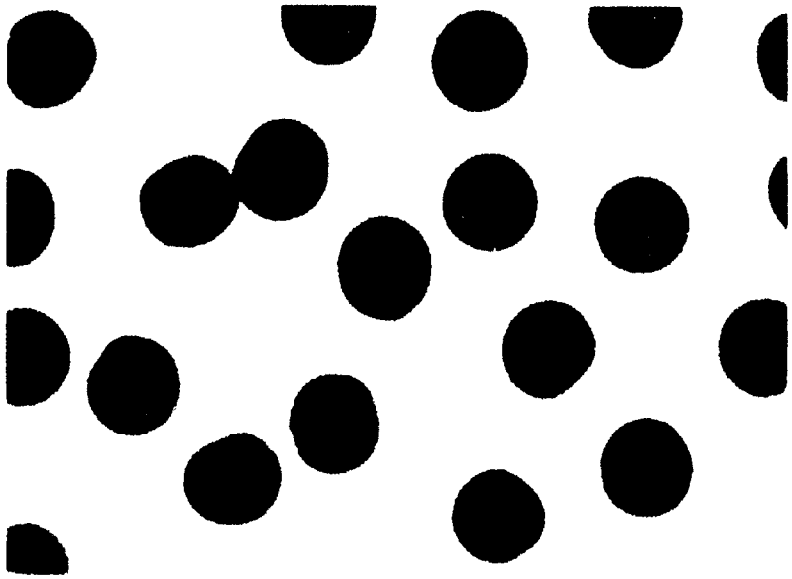
FIG. 15 is an enlarged diagram in which a dither dot is output on paper according to an ink-jet system.

Further, the present invention can also apply to a full color image forming apparatus on the tandem system shown in FIG. 10 and a full color image forming apparatus on the multiple developing system shown in FIG. 11.

The configuration of an image forming apparatus on the tandem system shown in FIG. 10 is described briefly.

This image forming apparatus comprises four image forming units, and each image forming unit comprises photosensitive drums 1*a*, 1*b*, 1*c* and 1*d*, primary charger 2*a*, 2*b*, 2*c* and 2*d*, the developing devices 4*a*, 4*b*, 4*c* and 4*d* respectively. Each toner of magenta, cyan, yellow or black is contained in the developing devices 4*a*, 4*b*, 4*c* and 4*d* respectively.

Then, when an image is formed, scanning exposure is first performed on each of the photosensitive drums 1*a*, 1*b*, 1*c* and 1*d* charged by each of the primary chargers 2*a*, 2*b*, 2*c* and 2*d* using the laser beam modulated corresponding to an image signal which is output from the exposure device 3 (laser scanning device) 3 and output from the image reading portion B to the printer portion A side. According, an electrostatic latent image which corresponds to each color of magenta, cyan, yellow and black is formed on each of the photosensitive drums 1*a*, 1*b*, 1*c* and 1*d* corresponding to the image information of an original G photoelectrically read by the image reading unit 21 respectively.

The electrostatic latent image formed on each of the photosensitive drums 1*a*, 1*b*, 1*c* and 1*d* is developed with the toner of each color of magenta, cyan, yellow and black respectively by each of the developing devices 4*a*, 4*b*, 4*c* and 4*d* and visualized as a toner image.

Then, synchronizing with the formation of a toner image of each color onto each of the photosensitive drums 1*a*, 1*b*, 1*c* and 1*d*, the toner image of each color (magenta, cyan, yellow or black) is sequentially transferred multiply to the transfer material P such as paper which is electrostatically adsorbed on the transfer belt 5 and conveyed and a full color image is formed.

The transfer material P on which a full color image was formed is discharged outside after it has been heated, pressurized and fixed by the fixing device 9.

Then, the present invention can apply to an image forming apparatus on this tandem system by installing an image forming unit provided with a developing device containing the cyan lt toner, a photosensitive drum and a primary charger and an image forming unit provided with a developing device containing the magenta lt toner, a photosensitive drum and a primary charger.

Next, the configuration of an image forming apparatus on the multiple developing system shown in FIG. 11 is described briefly.

This image forming apparatus comprises four developing devices 4*a*, 4*b*, 4*c* and 4*d*, and each toner of magenta, cyan, yellow or-black is contained in each of the developing devices 4*a*, 4*b*, 4*c* and 4*d* respectively.

Then, when an image is formed, scanning exposure is first performed on the photosensitive drum 1 charged by the primary charger 2 using the laser beam modulated corresponding to an image signal which is output from the exposure device 3 (laser scanning device) 3 and output from the image reading portion B to the printer portion A side. According, an electrostatic latent image which corresponds to each color of magenta, cyan, yellow and black is formed on the photosensitive drum 1 corresponding to the image information of an original G photoelectrically read by the image reading unit 21 respectively.

The electrostatic latent image formed on the photosensitive drum 1 is developed by sequentially superposing each color toner image with the toner of each color of magenta, cyan, yellow or black respectively by each of the developing devices 4*a*, 4*b*, 4*c* and 4*d* and visualized.

Then, synchronizing with the formation of the toner image of each color onto the photosensitive drum 1, the toner image of each color (magenta, cyan, yellow or black) sequentially superposed and developed on the photosensitive drum 1 is collectively transferred to the transfer material P such as paper conveyed between the transfer device 5 and the photosensitive drum 1 and a full color image is formed.

The transfer material P on which a full color image was formed is discharged outside after it has been heated, pressurized and fixed by the fixing device 9.

Further, the present invention can apply to this image forming apparatus on the multiple developing system by further additionally installing the developing device containing the cyan lt toner and the developing device containing the magenta lt toner.

What is claimed is:

1. An image forming apparatus comprising image forming means which can form a color image by superposing a toner image having a plurality of colors on a recording material, said image forming means including developing means for developing an electrostatic image formed on an image bearing member, said developing means including:

a first developing device for developing by use of a first cyan toner;

a second developing device for developing by use of a first magenta toner;

a third developing device for developing by use of a yellow toner;

a fourth developing device for developing by use of a second cyan toner that is lighter than the first cyan toner;

a fifth developing device for developing by use of a second magenta toner that is lighter than the first magenta toner, wherein a maximum reflection density of the second cyan toner is half or less of a maximum reflection density of the first cyan toner, and a maximum reflection density of the second magenta toner is half or less of a maximum reflection density of the first magenta toner, and a sixth developing device for developing by use of a black toner; and a first rotator which supports said first, second, third and sixth developing devices and a second rotator which supports said fourth and fifth developing devices.

2. An image forming apparatus according to claim 1, further comprising a third rotator, which supports the first, second, third, fourth, fifth and sixth developing devices.

3. An image forming apparatus according to claim 1, wherein for a first portion that is to have a first density in the electrostatic image, the developing is performed by use of the first cyan toner and the first magenta toner, and for a second portion that is to have a second density lower than the first density in the electrostatic image, the developing is performed by use of the second cyan toner and the second magenta toner.

4. An image forming apparatus according to claim 3, wherein an average particle diameter of the second cyan toner is 2 $\mu$m or more smaller than an average particle diameter of the first cyan toner, and an average particle diameter of the second magenta toner is 2 $\mu$m or more smaller than an average particle diameter than the first magenta toner.

5. An image forming apparatus according to claim 1, wherein said developing means performs the developing by said first, second, third and sixth developing devices when a normal mode is selected, and performs developing by said first, second, third, fourth, fifth and sixth developing devices when a special mode is selected.

6. An image formation method comprising an image forming step of forming a color image by superposing a toner image having a plurality of colors on a recording material, said image forming step including a developing step of developing an electrostatic image formed on an image bearing member, said developing step having:

a first developing step for developing by use of a first cyan toner;

a second developing step for developing by use of a first magenta toner;

a third developing step for developing by use of a yellow toner;

a fourth developing step for developing by use of a second cyan toner lighter than the first cyan toner;

a fifth developing step for developing by use of a second magenta toner lighter than the first magenta toner, wherein a maximum reflection density of the second cyan toner is half or less of a maximum reflection density of the first cyan toner, and a maximum reflection density of the second magenta toner is half or less of a maximum reflection density of the first magenta toner, and a sixth developing step for performing developing by use of a black toner; and wherein said image forming step forms an image by use of the first, second, third and sixth developing steps when a normal mode is selected, and forms an image by use of the first, second, third, fourth, fifth and sixth developing steps when a special mode is selected.

7. An image formation method according to claim 6, wherein for a first portion which is to have a first density in the electrostatic image, developing is performed by use of the first cyan toner and the first magenta toner, and for a second portion which is to have a second density lower than the first density in the electrostatic image, developing is performed by use of the second cyan toner and the second magenta toner.

8. An image formation method according to claim 7, wherein an average particle diameter of the second cyan toner is 2 $\mu$m or more smaller than an average particle diameter of the first cyan toner, and an average particle diameter of the second magenta toner is 2 $\mu$m or more smaller than an average particle size of the first magenta toner.

9. An image forming apparatus comprising image forming means which can form a color image by superposing a toner image having a plurality of colors on a recording material, said image forming means including developing means for developing an electrostatic image formed on an image bearing member, said developing means including:

a first developing device for developing by use of a first cyan toner;

a second developing device for developing by use of a first magenta toner;

a third developing device for developing by use of a yellow toner;

a fourth developing device for developing by use of a second cyan toner that is lighter than the first cyan toner;

a fifth developing device for developing by use of a second magenta toner that is lighter than the first magenta toner; and a sixth developing device for developing by use of a black toner; and a first rotator, which supports the first, second, third and sixth developing devices, and a second rotator which supports the fourth and fifth developing devices.

* * * * *

UNITED STATES PATENT AND TRADEMARK OFFICE

CERTIFICATE OF CORRECTION

PATENT NO. : 6,327,450 B1
DATED : December 4, 2001
INVENTOR(S) : Nobuyuki Ito

It is certified that error appears in the above-identified patent and that said Letters Patent is hereby corrected as shown below:

Title page,
Item [56], ABSTRACT,
Line 2, "has" should read -- has a --; and
Line 4, "use" should read -- by use --.

Column 1,
Line 39, "and" should be deleted; and
Line 43, "forth" should read -- form --.

Column 2,
Line 9, "ton®er" should read -- toner --; and
Line 57, "he" should read -- be --.

Column 3,
Line 7, "arid" should read -- and --; and
Line 34, "embodiment S" should read -- embodiment 2 --.

Column 4,
Line 14, "thus" should read -- the --.

Column 5,
Line 64, "a" should be deleted; and
Line 65, "arrow a" should read -- an arrow e --.

Column 6,
Line 29, "Nac1" should read -- NaC1 --;
Line 32, "sulfonates)" should read -- sulfonate) -- and "0.1×10"6" should read -- ($0.1\times10^{-6}$ --;
Line 34, " an" should read -- a --; and
Line 37, "a" should read -- an --.

Column 7,
Line 1, "screw 36." should read -- screw 37. --
Line 25, "oscillates" should read -- oscillate --;
Line 43, "portion C," should read -- portion C) --; and
Line 57, "adhering," should read -- adhering --.

Column 8,
Line 28, "arrow a counterclockwise" should read -- arrow e (counterclockwise --; and
Line 30, "in" should read -- and in --.

UNITED STATES PATENT AND TRADEMARK OFFICE

CERTIFICATE OF CORRECTION

PATENT NO. : 6,327,450 B1
DATED : December 4, 2001
INVENTOR(S) : Nobuyuki Ito

It is certified that error appears in the above-identified patent and that said Letters Patent is hereby corrected as shown below:

Column 10,
Line 3, "arid" should read -- and --;
Line 15, "immediate" should read -- immediately --;
Lines 64 and 66, "more" should be deleted.

Column 11,
Line 14, "device 4*l*" should read -- device 4b --;
Line 16, "device 4*r*" should read -- device 4 --;
Line 27, "device 4C1)" should read -- device 4C1 --;
Line 47, "to" should read -- can switch to --; and
Line 67, "3" should be deleted.

Column 12,
Lines 1 and 42, "According," should read -- Accordingly, --;
Line 34, "or-black" should read -- or black --;
Line 40, "3" (second occurrence) should be deleted.

Column 13,
Line 26, "toner," should read -- toner; --.

Column 14,
Line 15, "toner," should read -- toner; --; and
Line 38, "size" should read -- diameter --.

Signed and Sealed this

Seventh Day of May 2002

*Attest:*

*Attesting Officer*

JAMES E. ROGAN
*Director of the United States Patent and Trademark Office*